US005099987A

United States Patent [19]

Bieri

[11] Patent Number: 5,099,987

[45] Date of Patent: Mar. 31, 1992

[54] COMBINATION CONTACT LENS CASE AND INSPECTION UNIT

[76] Inventor: Fritz Bieri, Johannisbergstrasse 69, CH - 8645 Jona, Switzerland

[21] Appl. No.: 499,361

[22] PCT Filed: Sep. 1, 1989

[86] PCT No.: PCT/CH89/00160

§ 371 Date: May 7, 1990

§ 102(e) Date: May 7, 1990

[87] PCT Pub. No.: WO90/02496

PCT Pub. Date: Mar. 22, 1990

[30] Foreign Application Priority Data

Sep. 7, 1988 [CH] Switzerland ..... 3351/88

[51] Int. Cl.[5] ..... A45C 11/04

[52] U.S. Cl. ..... 206/5.1; 220/663

[58] Field of Search ..... 206/5.1; 220/66.2, 66.3; 134/137

[56] References Cited

U.S. PATENT DOCUMENTS 3,695,280 10/1972 Sturgeon ..... 206/5.1
4,392,569 7/1983 Shoup ..... 206/5.1
4,415,076 11/1983 Campbell ..... 206/5.1
4,545,479 10/1985 Figari ..... 206/5.1
4,623,249 11/1986 Grant ..... 206/5.1 X
4,710,023 12/1987 Loveridge ..... 206/5.1 X
4,782,946 11/1988 Pollak ..... 206/5.1 X

FOREIGN PATENT DOCUMENTS 2093605 9/1982 United Kingdom .

*Primary Examiner*—Paul T. Sewell
*Assistant Examiner*—Jacob K. Ackun, Jr.
*Attorney, Agent, or Firm*—Frishauf, Holtz, Goodman & Woodward

[57] ABSTRACT

A device for storing and examining contact lenses comprises a (1) with at least two cavities (2) in each of which one contact lens can be stored. The cavity (2) can be sealed by an air-tight, water-tight lid (3) and has a base specially shaped (21) to allow storage of the contact lenses. A liquid container (4,6) which communicates with the cavities through channels (5, 7) is arranged in the body. To examine the contact lenses stored in the cavities, the body (1) is held with the mat surface of the lid (3) pointing toward a light and the observer facing the lower surface of the body (1). At least one convex lens (10) which magnifies the image of the contact lens can be mounted on the lower surface (9). The contact lens can also be examined directly in the storage container (contact lens case) under focal illumination.

19 Claims, 1 Drawing Sheet

COMBINATION CONTACT LENS CASE AND INSPECTION UNIT

FIELD OF THE INVENTION

The invention relates to a case for storing as well as for inspecting contact lenses, the case being equipped with pockets or cavities capable of being closed, and holding contact lenses immersed in a suitable liquid.

BACKGROUND

A person who wears contact lenses is necessarily obliged to store the contact lenses in a safe place, be it during the night, or due to external conditions such as necessitated by the kind of his activities (swimming, surfing, sailing, combat sport), or due to a reduction in the comfort of wearing these lenses. It is also necessary to remove contact lenses due to a deterioration of the optical qualities caused by deposits like microorganisms covering the surface of the contact lens, or due to damages of these surfaces, for cleaning of the lenses. The known storage cases consist of a flat opaque piece formed with recesses for the contact lenses, which recesses can be closed by a threaded cover. Both hydrophilic and gas-permeable lenses should be stored in a humid atmosphere, because a hydrophilic lens may be destroyed when drying, whereas a gas-permeable lens changes its form. Storage in a humid surrounding permits asepsis of the lens due to antiseptic additives in the storage means.

As is well known, contact lenses must be inspected from time to time for deposits, microorganisms, fungi, mechanical damages and changes to to ageing. All these detrimentally influence wearing comfort; they possibly lead to complications on the eye itself.

Inspection of lenses can be carried out by an ophthalmologist or an optician. The necessity of such regular inspections will briefly be referred to in the following paragraphs.

As is known, organic and inorganic deposits are formed on the surfaces of the contact lenses, and microorganisms as well as fungi collect there as well. The inorganic deposits are parts of the lacrimal fluid such as proteins, mucines and lipids. The inorganic deposits (metals, iron, rust) are due to environmental conditions (air pollution, road dust, metal, abrasives). Additional inorganic deposits are those of calcium salts which are also called hard-water deposits. They are formed when flushing the lenses with tap water or due to a change of the pH value of the lacrimal fluid, e.g. due to medicaments or physiological influences. The microorganisms (bacteria, viruses) and fungi belong to the normal microflora of the conjunctiva, the conjunctiva sac and the lacrimal ducts. Changes occur when the balance of the microflora becomes disturbed, be it due to germ transfer via the hands, improper cleaning and desinfection, illness or metabolic disturbances (diabetic) of the lens wearer or due to contact of the lenses with the environment. In addition it is known that the contact lenses, in the course of their use, are subjected to changes, damages and ageing of their material. The changes of the material (e.g. discolorations) can be based on environmental influences (cigarette smoke, color vapors, cosmetics, staining of storage containers) ageing and also on standard cleaning methods. Lens damage (hairline cracks, abrasions, scratches, marginal fractures) are due to improper handling, dissication and cleaning of the lenses. These changes lead to a sequence of complications for the user or wearer. Serious complications with disadvantageous consequences for the eye concerned have already been described. On account of them, each wearer of contact lenses is instructed to periodically have his eyes and lenses inspected. The wearing of contact lenses leads, after a certain time, to troubles in the sensitivity of the cornea. Due to this, the wearer of contact lenses often feel the complications rather late, and valuable time is lost until they contact an ophthalmologist. A device that would enable each wearer to inspect his contact lenses in a simple manner might therefore avoid such complications in many cases.

Several cleaning methods are used. They are not listed here since they are not part of the invention. The inspection of the contact lenses could be effected by the wearer himself if he had a device easy to handle and at a reasonable price at his disposal. However, this self-inspection does not substitute the inspection by the contact lens specialist.

THE INVENTION

It is an object to provide the user of contact lenses with an improved storage case and a simple inspecting device, both devices being integrated in one unit.

Briefly, a body of transparent material has at least one, and preferably two or more cavities formed therein, each with a bottom which is paraboloid or concave shaped, to provide essentially only line engagement with a contact lens placed on the bottom. The body is additionally formed with a fluid reservoir cavity, for example surrounding the lens cavity or cavities, or between the cavities, communicating through communication ducts with the lens cavity. The lens cavity, or cavities, is closed off by closure plugs which extend into the lens cavity, or cavities, up to and close to a contact lens placed therein, with a spacing, for example of between 0.5 and 1 mm, to position the lens in the cavity, while being immersed in a fluid retained in the fluid reservoir and communicated to the lens cavity. The body, or the plug, respectively, can be shaped or have attached thereto an enlarging lens, so that the contact lens within the cavity can be viewed for surface deposits, deterioration, or for damage to the lens itself. The total immersion of the lens within a fluid in the cavities, including the lens cavity, permits storage of the contact lens under optimal conditions.

The storage and inspection unit has the advantage that the wearer is in a position to her/himself check the contact lenses during their storage. In this manner the dessication of the lenses which leads to their destruction can be avoided. To to the high humidity no pollution, reflexes, and artefacts can arise during the inspection, which is an especially important advantage.

DRAWINGS

The invention will now be explained by a detailed description of embodiments illustrated in the drawings. In these drawings:

FIG. 1 is a vertical section through the unit or device for storing and inspecting contact lenses; and FIG. 2 is a plan view of the same device.

DETAILED DESCRIPTION

Figure 1:
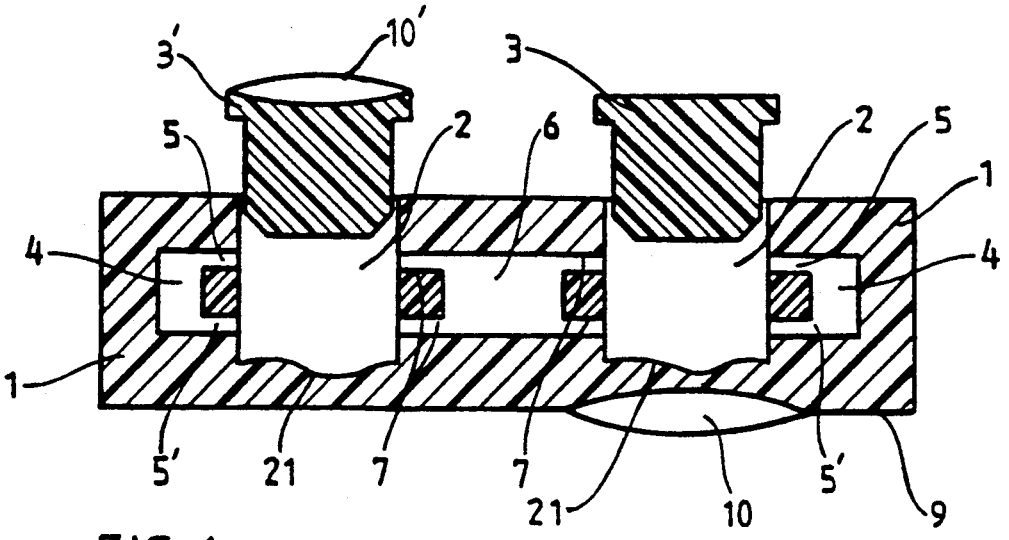

The device or unit illustrated in FIG. 1 comprises a body 1 of optically transparent material wherein two cavities 2, each for accomodating one contact lens per cavity, are provided. Each cavity is closed in a water-tight manner by a cover 3 made of transparent material. Preferably, a thread is provided on the cavity 2 and the cover 3 so that the cover can be threaded onto the cavity. Any other separable connection may be used as well such as e.g. a bayonet coupling or a plug-and-socket type connection. Bottom 21 of hollow 2 is formed in the manner of a paraboloid or a cone. In this way a contact lens comes to rest on it with its convex side in such a manner that between the lens and the bottom there exists only a line contact. Cover 3 can be inserted into cavity 2 only to such an extent that it cannot touch the contact lens, yet restrict its freedom of movement in the cavity. In this manner and with the line contact support, a complete view of all parts of the contact lens including the margin can be obtained.

In order to keep the cavity 2 wet, required by the contact lens, a fluid reservoir or container 4, 6 is provided. One of them, container 4, is provided on the lateral zone of body 1 and has a large volume for an aqueous solution. Such solutions are known as storage media for contact lenses. Container 4 is in the immediate vicinity of the small chamber in which the contact lens is immovably located. In the present embodiment, container 4 has circular shape (see FIG. 2). It may also be elliptic if the body 1 has that shape. Between cover 3 and the contact lens on bottom 21 there exists a gap of about 0.5 to 1 millimeter which permits sufficient circulation of fluid and prevents the lens from becoming damaged when the case is closed. Cavities 2 which are closed in a fluid-tight manner by covers 3 or 3', and which contain the contact lenses are filled in a similar way with fluid. If this initially were not the case, a light shaking of body 1 will distribute the fluid. Any air in cavities 2 can escape through ducts 5 into reservoirs 4, 6. Instead of container 4 another container 6 may be arranged in the central zone of body 1 as indicated with dashed lines. The encircling container or containers 6 is connected to cavities 2 by vertically spaced communicating channels 5, 5' and channels 7, respectively, and ensure ample supply of fluid to the contact lenses. Each cover 4, threaded or plugged into cavity 2, has grooves or cutouts, e.g. tapered surfaces on its side so that fluid container 4 or 6 may communicate easily with hollows 2 via cahnnels 5, 5' or 7 even when the cover would disturb the exit of upper channel 5 or the upper one of channels 7. In FIG. 1 a tapered end of the lower part of cover 3 is illustrated. Fluid reservoir 4 or 6 extends to the upper channel 5.

Figure 2:
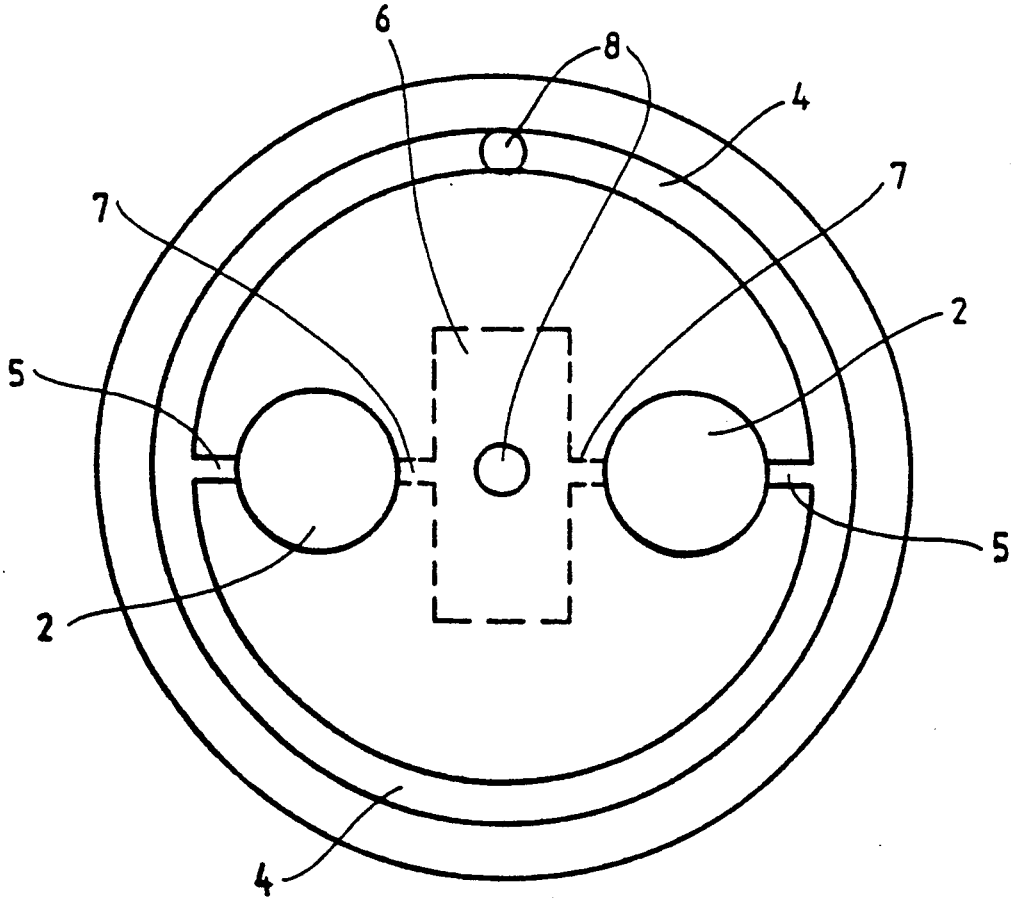

The plan view according to FIG. 2 shows the same items as FIG. 1 and illustrates the spatial arrangement of fluid containers 4, 6 and communicating channels 5, 7. The marginal zone of body 1 is illustrated as being circular but may equally well be elliptic or approximately rectangular. There may also be provided four cavities 2 which have corresponding channels leading to the containers 4, 6. The channels may also be arranged in a manner different from the illustration of FIG. 2.

In FIGS. 1 and 2 there are illustrated containers 4, 6 which provide sufficient fluid for the contact lenses in cavities 2. Fresh fluid can be brought into the containers by introducing it into cavities 2 from where it reaches the reservoirs 4, 6 via channels 5, 5', 7, or by filling it into a separate opening 8 which leads directly to the reservoirs or containers. The replacement of the fluid already in the containers by fresh one is effected in the same way. Such an exchange of the storage fluid is carried out daily as a rule, for reasons of sterility.

In accordance with a feature of the invention, the unit of FIGS. 1 and 2 permits the contact lenses stored in cavities 2 to be inspected and viewed. To do so, the observer holds cover 3 against a light source and views onto the lower side 9 of body 1. The surface of cover 3 is frosted or matte whereas lower side 9 of body 1 is smooth and transparent. It should be observed that the refractive indices of the optically transparent material of body 1, of cover 3 and fluid in cavity 2 must be close to each other so that no undesirable diffraction of the light rays can occur. The frosting of one of the surfaces provides a uniformly illuminated background in front of which the contact lens can be viewed.

The image of the contact lens viewed against the matte or frosted background can be magnified by means of a magnifying optic, e.g. a collimating lens 10 which is glued onto correspondingly shaped lower surface 9 in the vicinity of bottoms 21. For reasons of simplicity only one lens 10 is illustrated. Enlarging or converging lens 10 has a larger diameter than the contact lens to be viewed so that the entire surface of the contact lens can be inspected. There is also the possibility of glueing one big magnifying optic or collimating lens onto the entire surface of lower side 9. Care must only be taken to maintain a predetermined distance of the contact lens stored in hollow 2 to collimating lens 10. If the distance is less than the focus of the extra, enlarging lens, a virtual, magnified image of the contact lens is obtained. If the distance is between the focal length and double focal length of the lens, a real magnified image of the contact lens will be obtained.

In another embodiment, the magnifying optic or enlarging or convex lens 10' is arranged within cover 3' or on top of the central region of body 1. In this case cover 3' is smooth whereas lower side 9 of body 1 is matte or frosted.

So far, the transmitted light method for inspecting the contact lenses has been described. However, the contact lenses may also be viewed by using focal illumination, i.e. by means of a slit lamp.

With the present combined device or unit, contact lenses can be optimally stored as well as inspected. The device is inexpensive in its manufacture and easy to handle.

I claim:

1. Combined contact lens storage and inspection unit comprising a body (1) of transparent material;

at least one contact lens receiving cavity (2) formed in said body, said cavity having a bottom (21) of at least partly concave shape;

at least one fluid reservoir cavity (4, 6) formed in said body (1);

communicating fluid duct means (5,5',7) extending from the reservoir cavity to contact lens receiving cavity; and fluid-tight closure plug means (3) of optically transparent material, extending and projecting into said contact lens receiving cavity (2) up to a predetermined distance from a contact lens in the cavity located on the bottom (21) of the cavity, to maintain the contact lens within the cavity while immersed in a fluid within the fluid reservoir, said communicating duct means, and said lens receiving cavity, and permitting inspection of the contact lens while the contact lens is immersed in said fluid in said at last one cavity through said transparent material of the body (1) and said transparent plug means (3).

2. The unit of claim 1, wherein the bottom of the cavity is shaped to provide for essentially line engagement of the contact lens with the bottom (21).

3. The unit of claim 1, wherein said communicating duct means comprises two fluid channels (5, 5') spaced from each other longitudinally of said at least one cavity.

4. The unit of claim 1, wherein said body is formed with two cavities; and said fluid reservoir cavity (4) is ring-shaped and arranged in a marginal zone of said body (2) surrounding said two cavities.

5. The unit of claim 1, wherein said body is formed with two cavities; and wherein said fluid reservoir cavity (6) is located in a central zone of the body, between said contact lens receiving cavities.

6. The unit of claim 1, wherein the transparent closure plug means is formed with a frosted or matte surface;

and wherein the body (1) is formed with a base surface (9) aligned with said cavity, which is smooth and clearly transparent.

7. The unit of claim 1, wherein the body (1) has a bottom surface in line with said cavity, which is smooth and clearly transparent and includes a magnifying lens means (10).

8. The unit of claim 7, wherein the region of the body in alignment with the cavity is shaped to receive said magnifying lens, and formed to match the lens surface.

9. The unit of claim 1, wherein said fluid-tight closure plug means (3) comprises a magnifying lens (10') formed on the top cover thereof;

and wherein the body (1) has a base surface (9) which has a region in alignment with said cavity, said region being frosted or matte.

10. The unit of claim 7, wherein the focal length of said lens means (10) is greater than the spacing of said lens means (10) from the contact lens in the cavity.

11. The unit of claim 7, wherein the spacing between the lens means (10) and the contact lens in the cavity is between 1 to 2 times the focal length of said lens means (10).

12. The unit of claim 1, in combination with fluid in said fluid reservoir cavity, said communication fluid duct means, and said contact lens receiving cavity;

and wherein the refractive indices of the material of the body (1) of the closure plug means (3) and of the fluid in said cavities and the fluid duct means are close to each other to prevent undesirable diffraction of light within the body and interference with viewing of the contact lens in said contact lens receiving cavity.

13. The unit of claim 1, wherein the bottom (21) of the contact lens receiving cavity is shaped to define at least one of: a cone; a paraboloid.

14. The unit of claim 1, including a connection means for said closure plug means (3) for connecting said closure plug means into said contact lens receiving cavity (2), said connection means comprising at least one of: a threaded connection; a bayonet coupling; a plug-and-socket connection.

15. The unit of claim 1, wherein said body (1) is formed with a bottom surface (9) in alignment with said at least one cavity (2), and said closure plug means (3) is formed with a top surface;

and wherein one of said surface is smoothly transparent, and the other of said surfaces is matte or frosted.

16. The unit of claim 15, wherein said one surface includes an optical enlarging lens means (10, 10').

17. The unit of claim 1, wherein said closure plug means (3) extends into the contact lens receiving cavity (2) for a distance to space the bottom of said closure plug means from the contact lens within said cavity by between 0.5 to 1 mm.

18. The unit of claim 15, wherein the bottom of the cavity is shaped to provide for essentially line engagement of the contact lens with the bottom (21).

19. The unit of claim 3, wherein one (5') of said fluid channels terminates just above the bottom (21) of said at least one cavity; and the other (5) of said fluid channels terminates in said cavity at a higher level;

and wherein said fluid reservoir (4, 6) extends to said higher level.

* * * * *